US006954604B2

(12) United States Patent
Okada et al.

(10) Patent No.: US 6,954,604 B2
(45) Date of Patent: Oct. 11, 2005

(54) ELECTRONIC PHOTOGRAPHING APPARATUS

(75) Inventors: Hisao Okada, Ibaraki (JP); Masayoshi Nakayama, Ibaraki (JP)

(73) Assignee: Ricoh Printing Systems, Ltd., Tokyo (JP)

( * ) Notice: Subject to any disclaimer, the term of this patent is extended or adjusted under 35 U.S.C. 154(b) by 0 days.

(21) Appl. No.: 10/765,994

(22) Filed: Jan. 29, 2004

(65) Prior Publication Data

US 2004/0184842 A1 Sep. 23, 2004

(30) Foreign Application Priority Data

Jan. 31, 2003 (JP) ..... P2003-022916

(51) Int. Cl.[7] ..... G03G 15/08
(52) U.S. Cl. ..... 399/270; 399/285
(58) Field of Search ..... 399/270, 285, 399/267, 53, 58

(56) References Cited

U.S. PATENT DOCUMENTS 4,887,131 A * 12/1989 Kinoshita et al. ..... 399/275

FOREIGN PATENT DOCUMENTS

| | | |
|---|---|---|
| JP | 63-25350 | 5/1988 |
| JP | 3-2304 | 1/1991 |
| JP | 7-62779 | 7/1995 |
| JP | 8-1534 | 1/1996 |
| JP | 2646221 | 5/1997 |

* cited by examiner

*Primary Examiner*—Quana Grainger
(74) *Attorney, Agent, or Firm*—McGinn & Gibb, PLLC

(57) ABSTRACT

The invention provides an electronic photographing apparatus using a two-component developer as a mixture of a toner and a carrier as well as a development unit including a developer roll having magnetic poles therein. The electronic photographing apparatus includes a development bias power source for applying to the developer roll a development bias voltage where an AC voltage is superimposed on a DC voltage. The electronic photographing apparatus develops a latent image on a photosensitive body by using toner to form an image, characterized in that the ratio of the volume of the carrier to a space sandwiched between the developer roll and the photosensitive body is set within a range from 32 percent to 46 percent and that that the resistivity of the carrier under a field strength of 2000 V/cm is set to $3\times10^{10}$ Ωcm or more.

15 Claims, 2 Drawing Sheets

ELECTRONIC PHOTOGRAPHING APPARATUS

BACKGROUND OF THE INVENTION

1. Field of the Invention

The present invention relates to an electronic photographing apparatus which uses a two-component developer comprising a mixture of a toner and a carrier as a magnetic particle.

2. Description of the Related Art

On an electronic photographing apparatus, a photosensitive body is charged and exposure is performed in correspondence with image data to form charge distribution in accordance with an image pattern on the photosensitive body. In a development process, an electronic latent image is developed with toner in accordance with the charge distribution to cause the latent image to appear as a visible toner image. Then the toner image is transferred onto paper and fixed on the paper as an image by way of thermal fixing.

For the development process, there is provided a development system using a two-component developer comprising a mixture of a toner as a resin-coated colored powder particle 10 micrometers in grain diameter and a carrier as a magnetic particle of ferrite, magnetite or iron powder 50 to 150 micrometers in grain diameter.

A development unit uses a developer roll comprising an internal magnet and an external rotary cylinder to convey a developer to a development section as a gap between the photosensitive body and the developer roll. The developer conveyed to the development section is subject to an electric field determined by the relationship between a development bias voltage applied to the developer roll and surface potential distribution determined by the surface charge distribution of the photosensitive body. The toner component in the developer thus adheres to the photosensitive body in accordance with the surface charge distribution.

A method is known which uses a development bias voltage comprising an AC voltage superimposed on a DC voltage (for example, JP-B-63-25350, JP-B-3-02304). The advantage of the method using an AC voltage in the development bias voltage is that the amount of a toner used for development can be increased by superimposing an AC voltage on a DC voltage, compared with a case where the DC voltage alone is used, even in case the DC voltage is low. The advantage of the method is noticeable when it is used for non-contact development where a developer does not come in contact with a photosensitive body.

Further, approaches are known where the ratio of the volume occupied by magnetic particles to the space of a development section is 1.5 to 30 percent and the amount of a developer on the developer roll is 5 to 50 mg/cm$^2$ (for example, JP-B-01534) and setting the electric resistivity of a carrier to be used within a predetermined range (for example, JP-B-7-62779). As a related technology, an approach is known where the frequency of an AC component is set within a range of from 1000 to 3000 Hz (for example, Japanese Patent No. 2646221). The technologies help provide a good-quality image in case an AC voltage is superimposed on a development bias to acquire a development bias voltage.

SUMMARY OF THE INVENTION

The aforementioned technologies have been examined for a copier whose printing speed is about 10 A4 sheets per minute. Thus, it is impossible to obtain a sufficient good-quality image when the technologies are checked on a high-speed printer outputting 60 A4 sheets per minute. In particular, a sufficient image density is not obtained. The sufficient image density is 1.4 in terms of photoreflective density.

An object of the invention is to obtain a good-quality image in case an AC voltage is used as a development bias voltage on a high-speed printer or copier whose printing speed exceeds 60 A4 sheets per minute.

An object of the invention is attained by setting the ratio of the carrier volume to a space sandwiched between a developer roll and a photosensitive body within a range of from 32 percent to 46 percent. Further, an object of the invention is attained by setting the resistivity of the carrier under a field strength of 2000 V/cm to $3\times10^{10}$ Ωcm or more.

DETAILED DESCRIPTION OF THE PREFERRED EMBODIMENTS

Figure 1:
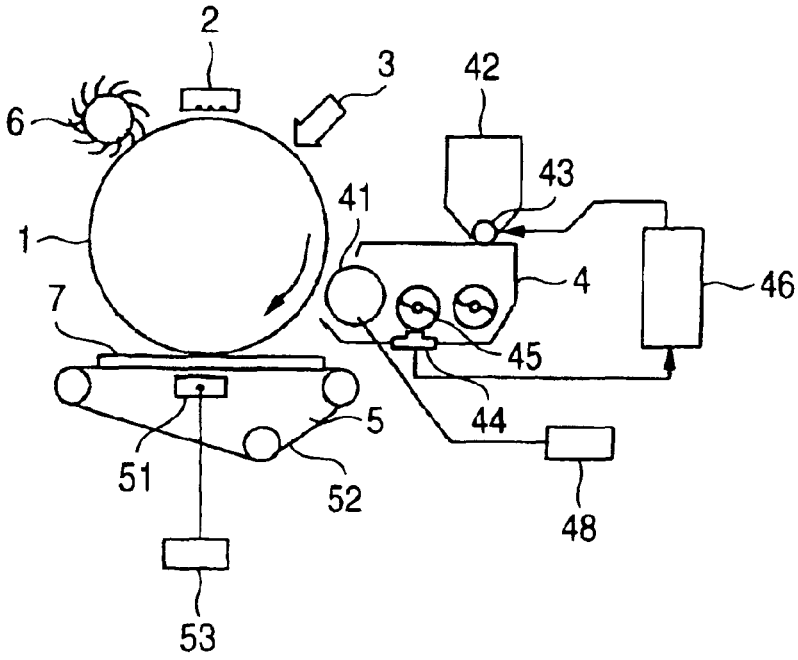
FIG. 1 is a block diagram showing a configuration of the invention.

The invention will be described below referring to the drawings. First of all, the image formation process of the electronic photographing apparatus is described referring to FIG. 1.

In FIG. 1, the surface of a photosensitive body 1 rotating clockwise is uniformly charged by a charger 2. An exposure unit 3 blinks a light depending on image data. On the photosensitive body 1, a portion where a light is irradiated is conducted to dissipate surface charge.

A developing unit 4 contains a two-component developer including a toner and a carrier. The two-component developer is conveyed to a region opposed to the photosensitive body 1 with the rotation of a developer roll 41 including a magnet therein. To the developer roll 41, a development bias voltage where an ac voltage is superimposed on a DC voltage is applied by a development bias power source 48. A toner having a same charging polarity as that of a photosensitive body adheres to the surface of the photosensitive body where the charge is dissipated by the action of the electric field between the photosensitive body and the developer roll. A toner image formed on the photosensitive body 1 is transferred to paper 7 by a transfer unit 5. The toner image transferred to the paper 7, although not shown, is fused by heating in a fixing unit and fixed on the paper 7. After that, toner remaining on the photosensitive body 1 is removed by a cleaner unit 6 and an image is subsequently formed in the same way. The toner removed by a cleaner unit 6 is collected by a toner hopper 42 and reused for development.

As toner is consumed for development, the toner density of the developer in the developing unit 4 drops and the output value from a toner density sensor 44 varies. When a controller detects that the toner density has dropped below a predetermined value compared with a reference value, the controller 46 drives a toner refilling roller 43 to refill toner into the developing unit 4 from the toner hopper 42. When the output of the toner density sensor 44 has reached a value corresponding to a predetermined toner density, the controller 46 deactivates the toner refilling roller 43 so that the toner density in the developing unit 4 will not become excessive.

A development section will be described below.

The toner supplied to a developer is mixed in the developer by rotating an agitating screw 45. Then the toner is dispersed into the developer and charged to a same charging polarity as that of the photosensitive body by friction charging with the carrier. In this way, the toner can be used continuously for development.

The transfer unit 5 shown in FIG. 1 employs belt transfer method. High voltage with reverse charging polarity of the toner is applied to a charger 51 from a transfer power source 53 to generate corona discharge in the charger 51. In that way, charge with reverse charging polarity of toner is provided on back surface of a belt 52 and the toner is transferred to the paper 7 conveyed onto the belt 52.

Figure 2:
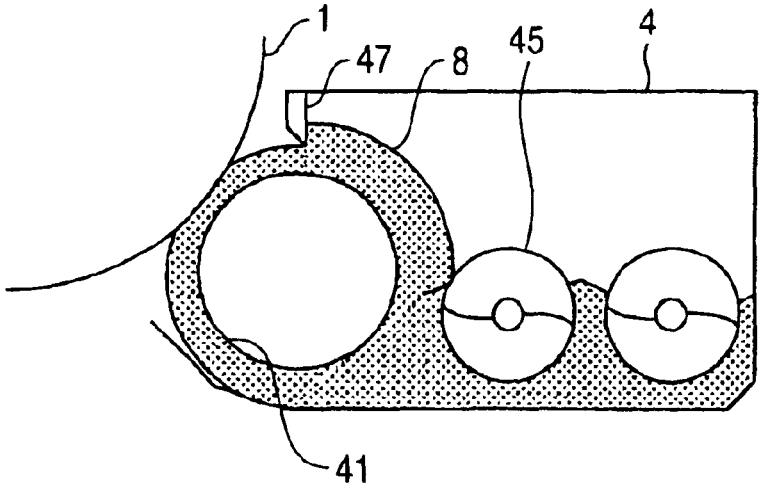
FIG. 2 is a sectional view of a development section in FIG. 1.

As shown in FIG. 2, the developer 8 in the developing unit 4 is conveyed on the developer roll with the rotation of the developer roll 41 (counterclockwise rotation in FIG. 2). Height of the developer conveyed is restricted by a developer restricting member 47. After passing through the developer restricting member 47, the developer with a uniform amount applied is conveyed to a development section being a portion opposed to the photosensitive body 1 and the developer roll 41.

The amount of a developer applied can be adjusted with an interval between the developer restricting member 47 and the developer roll 41. The interval is called a doctor gap. An interval between the photosensitive body 1 and the developer roll 41 is called a development gap.

Widening the doctor gap increases the amount of the developer-applied and the density of the volume occupied by the developer in the development section is increased. A force of rubbing the photosensitive body is also increased. An extremely high density unfavorably leaves trace of a rub by carriers on a printed image. Thus, in the related art technology, the ratio of the volume occupied by carriers in the space of the development section is set to 1.5 to 30 percent so as to keep the carriers sparse in the development section, thereby preventing the effect of a rub by the carriers from appearing on a printed image. Note that the ratio of the volume occupied by carriers in the space of the development section is obtained by dividing the weight of the carriers alone out of the amount of the developer applied by the carrier density and then by the development gap, as described in JP-B-01534.

An experiment on a printer outputting at least 60 A4 sheets per minute has revealed that a sufficient image density is not obtained and the resulting image shows the effect of a rub. The reason is that, on a related art low-speed copier, it takes a lot of time for a developer to pass through a development section thus the amount of toner in the developer moving onto a photosensitive body within the time is large, so that a sufficient amount is used for development. Meanwhile, on a high-speed printer, it takes only a short time for a developer to pass through a development section so that the toner amount used for development on a photosensitive body is small. The trace of a rub on an image obtained is attributable to the fact that toner which could be rubbed, or deposited on carriers and come into direct contact with the photosensitive body was readily consumed for development.

As a result, on a high-speed printer, the time toner is used for development on the photosensitive body is short. Same as the related art, a sufficient amount of toner cannot be used for development by using a small amount of developer applied.

Thus, the conditions for a developer are examined to determine the conditions under which a sufficient image density is obtained.

The examination used an LB060A type modified machine from Hitachi Koki capable of outputting 60 A4 sheets per minute. The development section has a development gap of 0.8 mm. Talking of the developer components, the carrier is a resin-coated magnetite carrier 95 $\mu$m in average grain diameter and the toner density is 3 percent. The image density is adjustable by a development bias voltage and the velocity of the developer roll. Under extreme conditions, an image degradation caused by dirt in the background such as fogging may result, so that the range the image density is properly used is limited. The DC component of the development bias voltage is 300 V to 500 V and the velocity of the developer roll is 1.4 to 2.1 times that of the photosensitive body in terms of peripheral speed ratio. Within this range, a problem of a poor image will not occur. The aforementioned experiment is executed under the mean conditions of that range, a DC bias component of 400 V and a peripheral speed ratio of 1.8. A sine wave representing an AC bias having a peak-to-peak voltage of 1400 V and a frequency of 4 kHz is superimposed.

The results of the examination as shown in Table 1 are obtained concerning the relationship between the carrier volume ratio in the development section, image density, and the amount of the developer applied to the developer roll.

TABLE 1

| Condition | Volume ratio | Amount of developer applied (per $cm^2$) | Image density |
|---|---|---|---|
| No. 1 | 11% | 44 mg | 0.80 |
| No. 2 | 26% | 106 mg | 1.35 |
| No. 3 | 32% | 131 mg | 1.40 |
| No. 4 | 40% | 163 mg | 1.40 |
| No. 5 | 46% | 188 mg | 1.40 |

From the results, it is understood that a sufficient image density is obtained with a carrier volume ratio in the developer being 32 percent or more. In case the volume ratio exceeds 46 percent, the resulting image shows the effect of a rub. Thus, it is understood that the volume ratio free from the effect of a rub and providing a sufficient image density is between 32 percent and 46 percent.

Next, the examination results on the electric resistivity of the carrier used under the above conditions are described below.

In a low resistance, a problem of carrier stick takes place where carrier particles are deposited onto a photosensitive body to develop a latent image in case the difference between the potential of a photosensitive body and the potential of a developer roller increases when applying DC vias. The carrier stick prevents an image around portions where the carrier is deposited from being transferred thus causing an image defect. The carrier stick is a phenomenon where an electric charge is injected into a carrier particle to cause electrostatic absorption of the carrier particle onto a photosensitive body when the difference between the potential of the photosensitive body and that of the developer roll has become large. This phenomenon frequently occurs when the carrier resistance is small and the electric charge is easily injected. In case an AC voltage is superimposed on a development bias voltage, a period where the potential difference is large takes place, which invites injection of electric charge and the resulting carrier stick. Even when carrier resistance is high, in case the ratio of the volume occupied by carriers to the space of the developer is large, as in this embodiment, the number of contact points between carrier particles increases in the gap between the photosensitive body 1 and the developer roll 41. Thus the overall electric resistance drops and invites charge injection, which spurs carrier stick. Use of a high-resistivity carrier is effective for suppressing carrier stick. The results of the examination will be described below.

Figure 3:
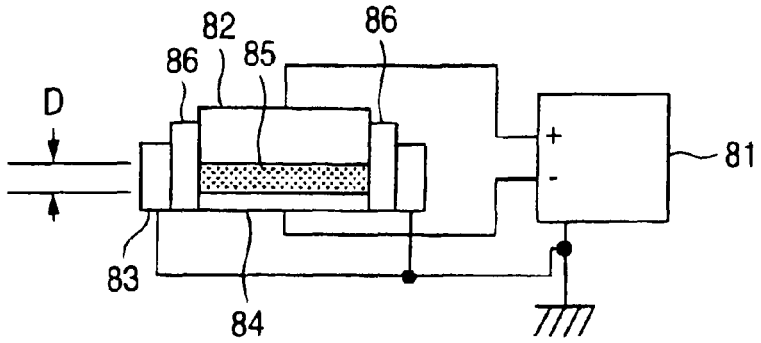
FIG. 3 is a block diagram of a carrier resistance measuring instrument according to the invention.

A method for measuring the electric resistance of a carrier is described below. FIG. 3 shows a general configuration of the apparatus used for measurement. As shown in FIG. 3, a carrier 85 is sandwiched between upper and lower electrodes 82 and 84, and the electric resistance is measured on a high-resistance meter 81. The resistivity is obtained by multiplying the measured resistance value by the area of the electrodes 82, 84 and dividing the result by a carrier thickness D. Conditions for resistance measurement are: a carrier thickness is 0.4 cm; a load applied to the carrier is 0.25 $kg/cm^2$ through adjustment of the weight of the upper electrode 82; and the field strength applied to the carrier is made variable as a parameter. In FIG. 3, a guard electrode 83 and an insulating resin 86 are intended to avoid a possible measurement error. This approach is a typical practice in high-resistance measurement.

Figure 4:
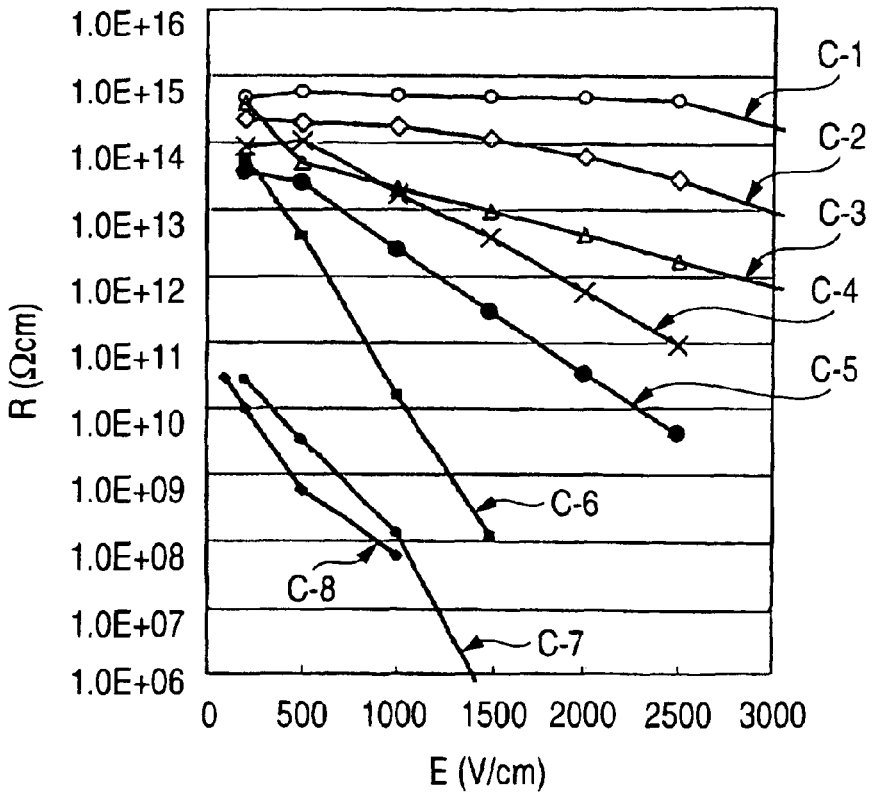
FIG. 4 shows the applied field strength characteristic of the carrier resistance.

The carriers measured are listed below. FIG. 4 shows the resistivity-applied field strength characteristic of each of the carriers. The carrier resistance is varied by adjusting the amount of a coating resin and the amount of a conductive agent added to the resin. The carrier conditions are shown in Table 2.

TABLE 2

| Symbol | Grain diameter ($\mu$m) | Coating conditions |
|---|---|---|
| C-1 | 55 | Resin amount: 3<br>Conductive agent amount: 0 |
| C-2 | 55 | Resin amount: 2<br>Conductive agent amount: 0 |
| C-3 | 55 | Resin amount: 1<br>Conductive agent amount: 0 |
| C-4 | 55 | Resin amount: 3<br>Conductive agent amount: 0.3 |
| C-5 | 55 | Resin amount: 3<br>Conductive agent amount: 0.4 |
| C-6 | 65 | Resin amount: 1<br>Conductive agent amount: 0.5 |
| C-7 | 80 | Resin amount: 1<br>Conductive agent amount: 0.5 |
| C-8 | 95 | Resin amount: 1<br>Conductive agent amount: 1.0<br>(reference coating conditions) |

The horizontal axis E in FIG. 4 represents a field strength applied to a carrier and the vertical axis a resistivity.

As understood from FIG. 4, the carrier resistance has a characteristic which decreases carrier resistance as the applied field strength is increased. This is a general characteristic of a carrier and is based on the fact that, as the field strength increases, the insulation performance of the carrier coated with resin is gradually degraded or insulation partially fails thus allowing a small electric current to flow.

As shown in FIG. 4, it is understood, from the comparison between C-1, C-2 and C-3, that the resistance decreases as the amount of a coating resin is reduced. This is because the insulation performance is degraded as the coating resin gets thinner so that the insulation is destroyed when the field strength is high enough. From C-1, C-4 and C-5, it is understood that the resistance decreases as the amount of a conductive agent to be added is increased. Increasing the amount of the conductive agent to be added elevates the field strength in a portion where the conductive agent is present in the coating resin, which will destroy the insulation. Further, for C-6, C-7 and C-8 where resistance is decreased with increased conductive agent, it is expected that the resistance values are considerably small. Thus, the carrier grain diameter is increased to reduce carrier stick in a development experiment.

In case an AC bias voltage is superimposed under the conditions where these carriers occupy a volume of 40 percent of the development section, the carriers C-1 through C5 does not cause any problem of image quality resulting from carrier stick. The carriers C-6, C-7 and C-8 cause carrier stick which results in image defect. In particular, C-8 is a carrier having a grain diameter which will suppress carrier stick with a DC development bias voltage alone, but carrier stick cannot be suppressed in case an AC voltage is superimposed.

In case such a carrier is used, superimposing an AC voltage generates a dot-shaped flaw on the photosensitive body which appears as a black dot on the printed image. A low carrier resistance causes the voltage applied to the developer roll to directly act on the surface of the photosensitive body. This results in an electric discharge from the carrier end to the photosensitive body in an AC voltage phase where the potential difference between the photosensitive body and the developer roll is large. As a result, a hole appears in the photosensitive body to reveal the electrode underneath, which is no longer charged, so that toner is attracted to that portion and appears as a black dot.

From these experiments, it is understood that the carrier resistivity must be set higher than before in case an AC bias voltage is used while the ratio of the carrier volume to the space of the development section is high, for example 32 to 46 percent, rather than 1.5 to 30 percent in the related art practices.

As shown in FIG. 4, from the performance of the carrier C-5, when resistivity is $3\times10^{10}$ Ωcm or more under a field strength of 2000 V/cm, carrier stick is suppressed to avoid an adverse effect on the image quality in the presence of a bias voltage as a DC voltage having an AC bias voltage superimposed thereon. Electric discharge does not take place and the photosensitive body is free from flaws.

As described hereinabove, on a high-speed printer outputting 60 A4 sheets per minute, reducing the amount of a developer applied to a developer roll to decrease the volume occupied by carrier particles in the development section prevents consumption of a sufficient amount of toner for development. This phenomenon is eliminated by increasing the amount of a developer applied thus increasing the ratio of the volume of carrier particles to the space of the development section, while compensating the resulting drop in the overall resistance by setting the carrier resistivity to a higher value. It is thus possible to introduce an AC bias voltage into the development bias voltage and obtain a good-quality image free from the effect of rubbing.

According to the invention, it is possible to use, on a high-speed printer, a development bias voltage where an AC bias voltage is superimposed and obtain a good-quality image.

The foregoing description of the preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. An electronic photographing apparatus comprising:

a developer comprising a toner and a carrier;

a development unit comprising a developer roll having magnetic poles therein;

a development bias power source for applying to the developer roll a development bias voltage where an AC voltage is superimposed on a DC voltage; and a photosensitive body, wherein the electronic photographing apparatus develops a latent image on the photosensitive body by using the toner to form an image, and wherein the ratio of the volume of the carrier in a space sandwiched between the developer roll and the photosensitive body is within a range of from 32 percent to 46 percent.

2. The electronic photograph apparatus according to claim 1, wherein the carrier comprises a resistivity of at least $3\times10^{10}$ Ωcm under a field strength of 2000 V/cm.

3. The electronic photographing apparatus according to claim 1, wherein said apparatus comprises one of a high-speed printer and a high-speed copier.

4. The electronic photograph apparatus according to claim 1, wherein said apparatus comprises a printing speed greater than 60 sheets per minute.

5. The electronic photograph apparatus according to claim 1, wherein said ratio comprises a ratio of said volume of said carrier to a volume of said space.

6. The electronic photograph apparatus according to claim 1, wherein said carrier comprises a sufficient resistivity for inhibiting carrier sticking.

7. The electronic photograph apparatus according to claim 1, wherein said carrier comprises a coating resin and a conductive agent.

8. The electronic photograph apparatus according to claim 7, wherein an amount of said coating resin and an amount of said conductive agent are selected for providing a predetermined carrier resistivity.

9. The electronic photograph apparatus according to claim 1, wherein said ratio is obtained by dividing a weight percentage of said carrier alone out of an amount of said developer applied by a carrier density and then by said development gap.

10. The electronic photograph apparatus according to claim 1, wherein said ratio is selected for providing a sufficient image density.

11. The electronic photograph apparatus according to claim 1, wherein a DC component of said development bias power source is in a range from 300 V to 500 V.

12. The electronic photograph apparatus according to claim 2, wherein said resistivity is obtained by multiplying a resistance by an electrode area, and dividing a result of said multiplying by a carrier thickness.

13. An electronic photographing apparatus, comprising:

a development unit comprising a developer roll and containing a developer comprising a toner and a carrier; and a photosensitive body for adjusting to said developing unit, a latent image being formed on said photosensitive body using said toner, wherein the ratio of the volume of the carrier in a space between the developer roll and the photosensitive body to a volume of said space is within a range of from 32 to 46.

14. The electronic photograph apparatus according to claim 13, wherein the carrier comprises a resistivity of at least $3\times10^{10}$ Ωcm under a field strength of 2000 V/cm.

15. A high speed printer, comprising:

a development unit comprising a developer roll and containing a developer comprising a toner and a carrier; and a photosensitive body for adjusting to said developing unit, a latent image being formed on said photosensitive body using said toner, wherein the ratio of the volume of the carrier in a space between the developer roll and the photosensitive body to a volume of said space is within a range of from 32 to 46.

* * * * *